US012152337B2

(12) United States Patent
Yu

(10) Patent No.: US 12,152,337 B2
(45) Date of Patent: Nov. 26, 2024

(54) HANDHELD GARMENT STEAMER

(71) Applicant: Shenzhen Pukaiyu Technology Co., Ltd., Shenzhen (CN)

(72) Inventor: YongHua Yu, Jiujiang (CN)

(73) Assignee: Shenzhen Pukaiyu Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/119,828

(22) Filed: Mar. 10, 2023

(65) Prior Publication Data

US 2023/0212815 A1 Jul. 6, 2023

(30) Foreign Application Priority Data

Feb. 3, 2023 (CN) ..... 202320232247.0

(51) Int. Cl.
*D06F 75/14* (2006.01)
*D06F 75/20* (2006.01)
*D06F 75/26* (2006.01)

(52) U.S. Cl.
CPC ..... *D06F 75/14* (2013.01); *D06F 75/20* (2013.01); *D06F 75/26* (2013.01)

(58) Field of Classification Search
CPC ..... D06F 75/08; D06F 75/20; D06F 75/24; D06F 75/26
See application file for complete search history.

(56) References Cited

U.S. PATENT DOCUMENTS 3,620,055 A * 11/1971 Blachly et al. ..... D06F 75/30 392/404
3,675,449 A * 7/1972 Bluestein ..... D06F 75/30 15/176.3
4,243,870 A * 1/1981 Grime ..... F24H 9/2021 70/389
5,420,961 A * 5/1995 Walker ..... A61H 33/063 392/404
5,748,836 A * 5/1998 Moore ..... H05B 3/03 392/313
D481,183 S * 10/2003 Mangano ..... D32/17
6,842,918 B2 * 1/2005 Fung ..... A61H 33/12 4/537

(Continued)

FOREIGN PATENT DOCUMENTS

CN 206529623 U * 9/2017
CN 105726294 B * 5/2018
JP 3215613 U * 4/2018

*Primary Examiner* — Ismael Izaguirre
(74) *Attorney, Agent, or Firm* — Hemisphere Law, PLLC; Zhigang Ma

(57) ABSTRACT

The present disclosure provides a handheld garment steamer, including a water tank, an evaporator, a power pump and a nozzle, wherein the water tank is used for storing water; the water tank is arranged below the water tank and is used for heating the water to turn the water into water vapor; the power pump is connected with the water tank and the evaporator and is used for pumping the water in the water tank to the evaporator; the nozzle is arranged above the water tank; and a vent of the nozzle is connected with the evaporator through a steam pipe. In the present disclosure, a center of gravity of the garment steamer is at the bottom, so that the garment steam is not easy to tilt during use, and the operation is more labor-saving.

10 Claims, 6 Drawing Sheets

(56) References Cited

U.S. PATENT DOCUMENTS

| | | | | |
|---|---|---|---|---|
| 2006/0191299 | A1 | 8/2006 | Tobias | |
| 2009/0255302 | A1 | 10/2009 | Haan | |
| 2018/0038585 | A1* | 2/2018 | Zhang | F22B 37/106 |
| 2020/0149214 | A1 | 5/2020 | Yao | |
| 2022/0145527 | A1* | 5/2022 | Chong | D06F 75/36 |

* cited by examiner

HANDHELD GARMENT STEAMER

TECHNICAL FIELD

The present disclosure relates to a handheld garment steamer.

BACKGROUND

A garment steamer heats water to generate steam and then sprays the steam onto clothes to realize care of the clothes. In the prior art, an evaporator of a handheld garment steamer is arranged at a top end. Due to a relatively large mass of the evaporator, the handheld garment steamer appears to be top-heavy during use, and is cumbersome. When a user holds the garment steamer, a nozzle of the garment steamer tends to sink. The garment steamer tends to tilt when the user moves the garment steamer up and down against a surface of clothes for ironing, so the user needs to spend more effort to overcome the tilting, which is relatively laborious.

SUMMARY

In view of this, it is necessary to provide a handheld garment steamer, so that a center of gravity of the garment steamer is at the bottom; the garment steam is not easy to tilt during use; and less effort is required.

The present disclosure provides a handheld garment steamer, including:

- a water tank, used for storing water;
- an evaporator, arranged below the water tank and used for heating the water to make the water become water vapor;
- a power pump, connected with the water tank and the evaporator and used for pumping the water in the water tank to the evaporator; and
- a nozzle, arranged above the water tank, wherein a vent of the nozzle is connected with the evaporator through a steam pipe.

In the present disclosure, the relatively heavy evaporator is arranged below the water tank. The vent at the top is connected with the evaporator through the steam pipe. After water is injected to the water tank, the center of gravity of the handheld garment steamer is close to the bottom of the handheld garment steamer. Therefore, the garment steamer is not easy to tilt during use. A user will not spend extra effort to prevent the garment steamer from tilting when moving the garment steamer up and down to care for clothes, so that the operation is more labor-saving.

DETAILED DESCRIPTION OF THE EMBODIMENTS

The technical schemes in the embodiments of the present disclosure will be clearly and completely described below with reference to the drawings in the embodiments of the present disclosure, and it is obvious that the described embodiments are only a part of the embodiments of the present disclosure but not all of them.

Figure 1:
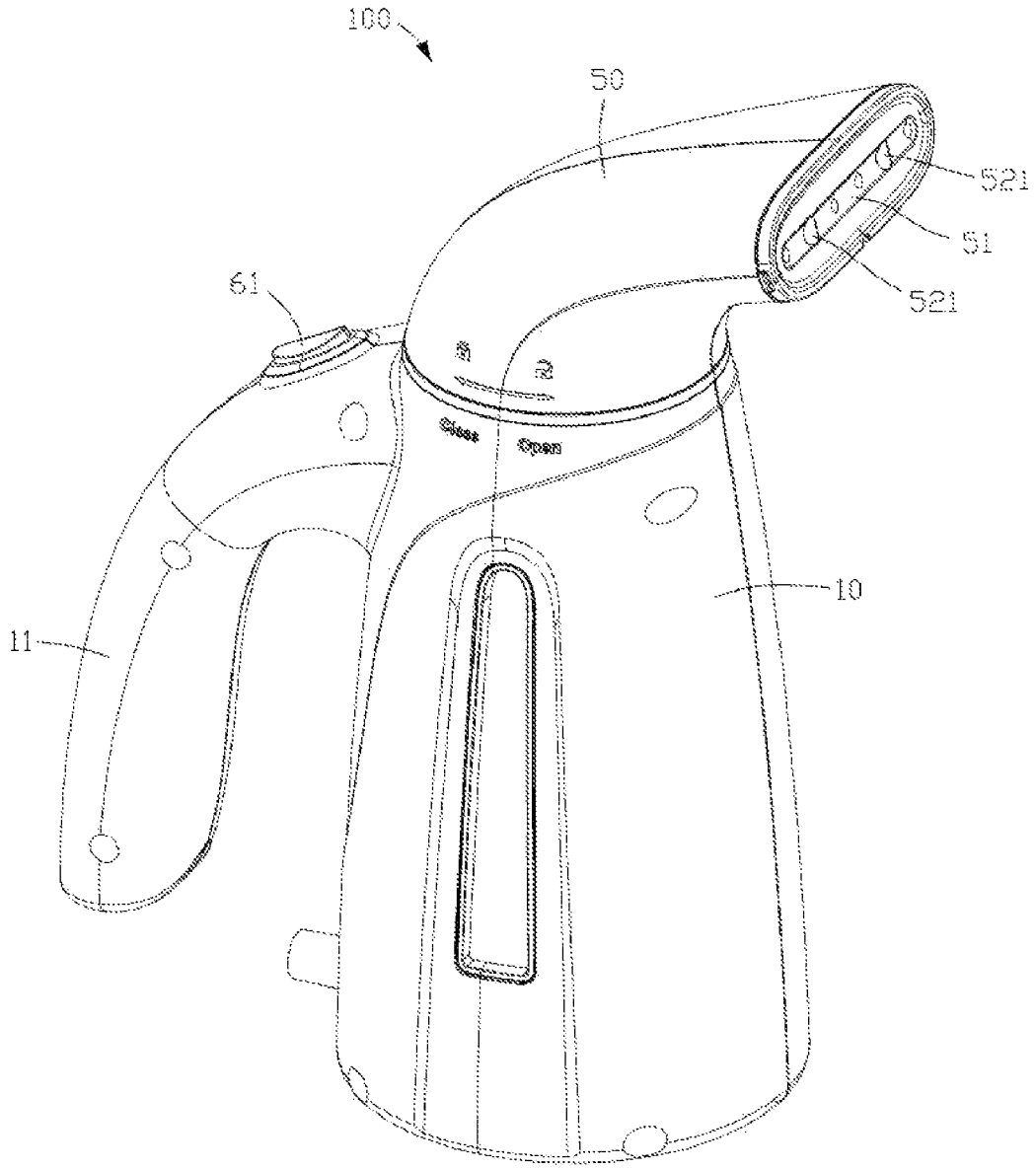
FIG. 1 is a schematic structural diagram of a specific implementation of the present disclosure.
Figure 2:
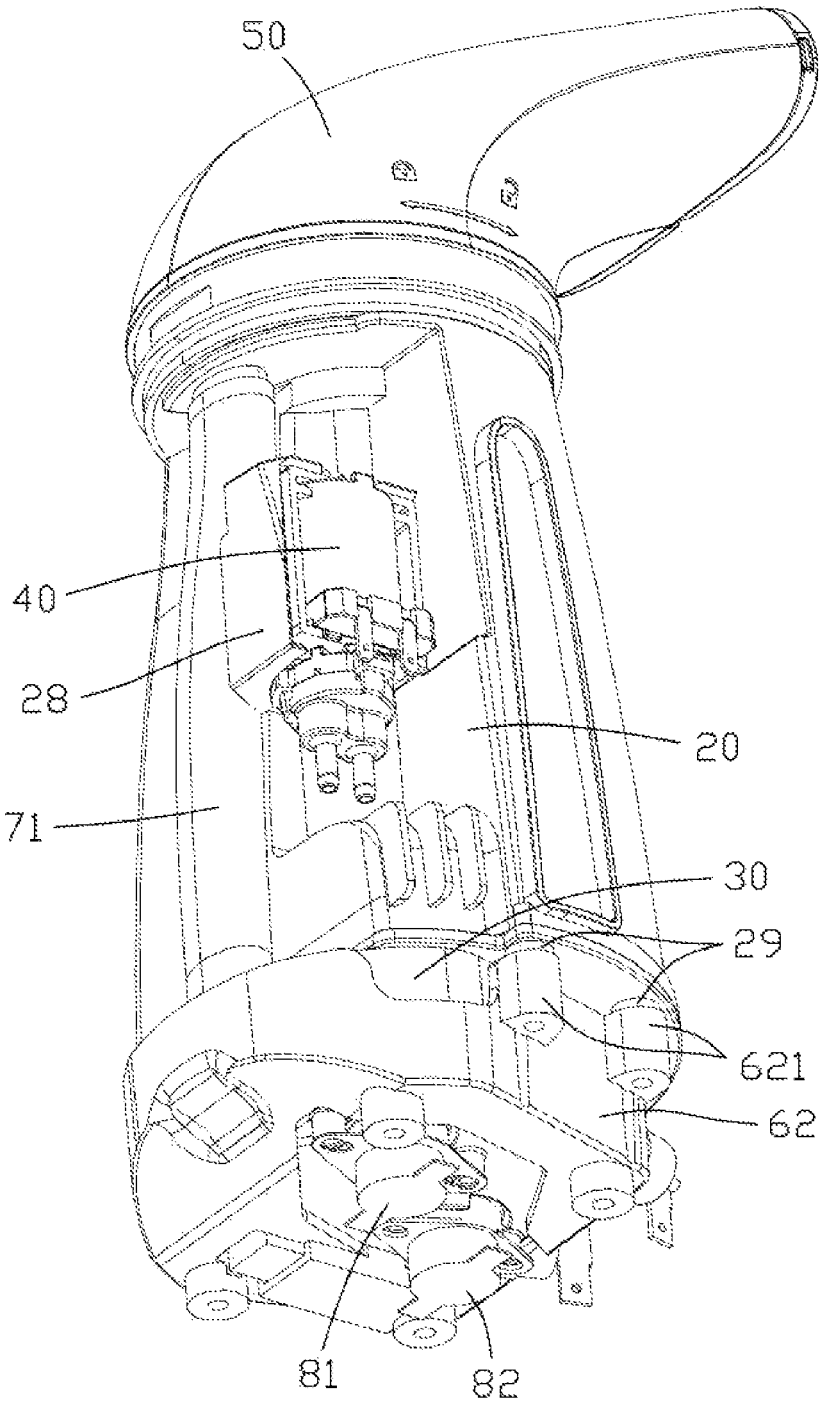
FIG. 2 is a schematic diagram of an internal structure of a specific implementation of the present disclosure.

According to a specific implementation of the present disclosure, the present disclosure provides a handheld garment steamer 100. As shown in FIG. 1 and FIG. 2, the garment steamer 100 includes a housing 10, a water tank 20, an evaporator 30, a power pump 40 and a nozzle 50. The water tank 20 is mounted through the housing 10. The water tank 20 is used for storing water. The housing 10 is formed with a handle 11 which is vertically disposed. The handle 11 is provided with a switch button 61. The switch button 61 controls running of the garment steamer 100.

The evaporator 30 is arranged below the water tank 20. The evaporator 30 is fixed at an inner bottom of the housing 10 through a mounting bracket 62. The mounting bracket 62 is provided with a positioning hole 621. A positioning pillar 29 is arranged at a bottom of the water tank 20. The positioning pillar 29 is plugged into the positioning hole 621.

Figure 3:
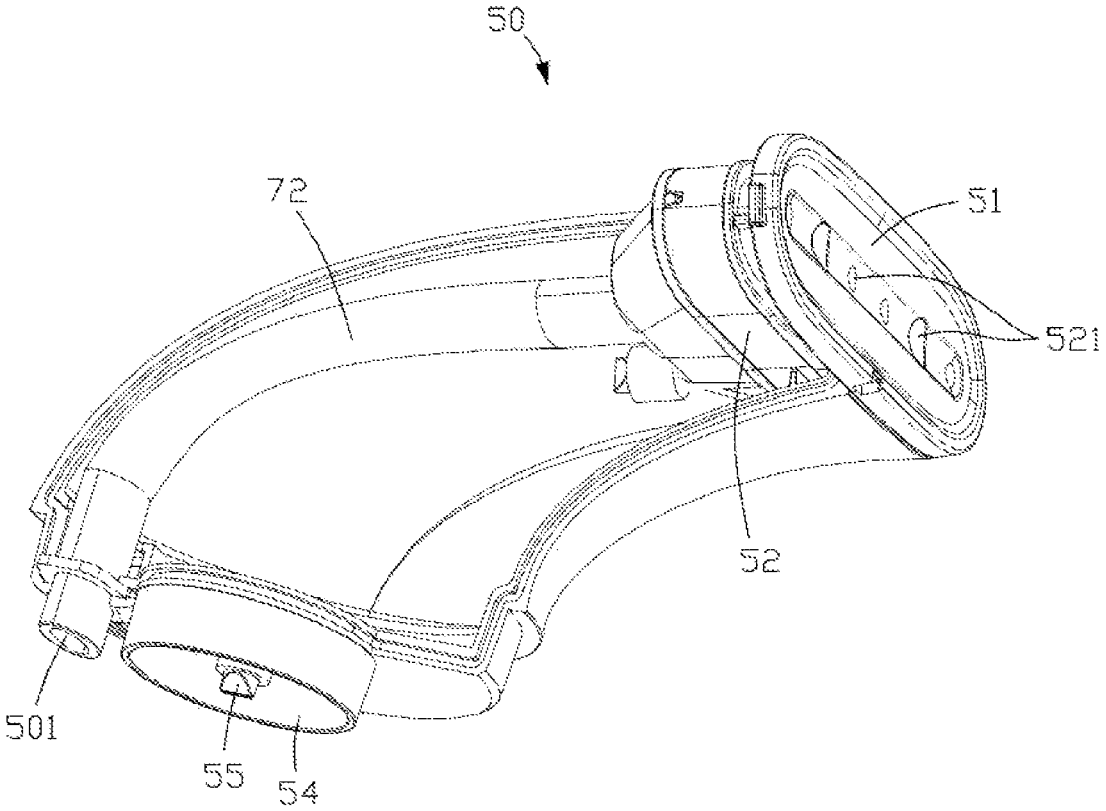
FIG. 3 is a schematic diagram of a specific structure of a nozzle of a specific implementation of the present disclosure.

The nozzle 50 is arranged above the water tank 20. The nozzle 50 gradually extends upward and laterally, thereby forming a spraying surface 51 at an end portion. The spraying surface 51 is approximately vertical. As shown in FIG. 3, the nozzle 50 is provided with a steam chamber 52. The steam chamber 52 is provided with a vent 521. The vent 521 is perpendicular to the spraying surface 51. Steam enters into the steam chamber 52 and is sprayed from the vent 521, thus forming a steam flow sprayed laterally.

In the present disclosure, the relatively heavy evaporator 30 is arranged below the water tank 20. The vent 521 at the top is connected with the evaporator 30 through steam pipes 71 and 72. After water is injected to the water tank 20, the center of gravity of the handheld garment steamer 100 is close to the bottom of the handheld garment steamer. Therefore, the garment steamer 100 is not easy to tilt during use. A user will not spend extra effort to prevent the garment steamer 100 from tilting when moving the garment steamer 100 up and down to care for clothes, so that the operation is more labor-saving.

A side surface of the water tank 20 is provided with a mounting frame 28. The mounting frame 28 is used for fixing the power pump 40. The power pump 40 is connected with the water tank 20 and the evaporator 30. The power pump 40 is used for pumping the water in the water tank 20 to the evaporator 30. The evaporator 30 heats the water to turn it into water vapor. The steam flows from the evaporator 30 to the vent 521 through the steam pipes 71 and 72 connected to the vent 521 and the evaporator 30, and is then sprayed from the vent 521.

A first temperature controller 81 and a second temperature controller 82 are arranged below the evaporator 30. The first temperature controller 81 and the second temperature controller 82 are used for monitoring a temperature of the evaporator 30. When the temperature of the evaporator 30 reaches a first preset temperature value, the second temperature controller 82 and the water pump work. When the temperature of the evaporator 30 reaches the second preset temperature value, the evaporator 30 is powered off. The second preset temperature value is greater than the first preset temperature value. The first preset temperature value is set to prevent the water from entering the evaporator 30 due to an insufficient temperature of the evaporator and causing that only the water is sprayed and no steam is produced. The second preset temperature value is set to prevent the evaporator 30 from burning out due to an excessive temperature.

Figure 4:
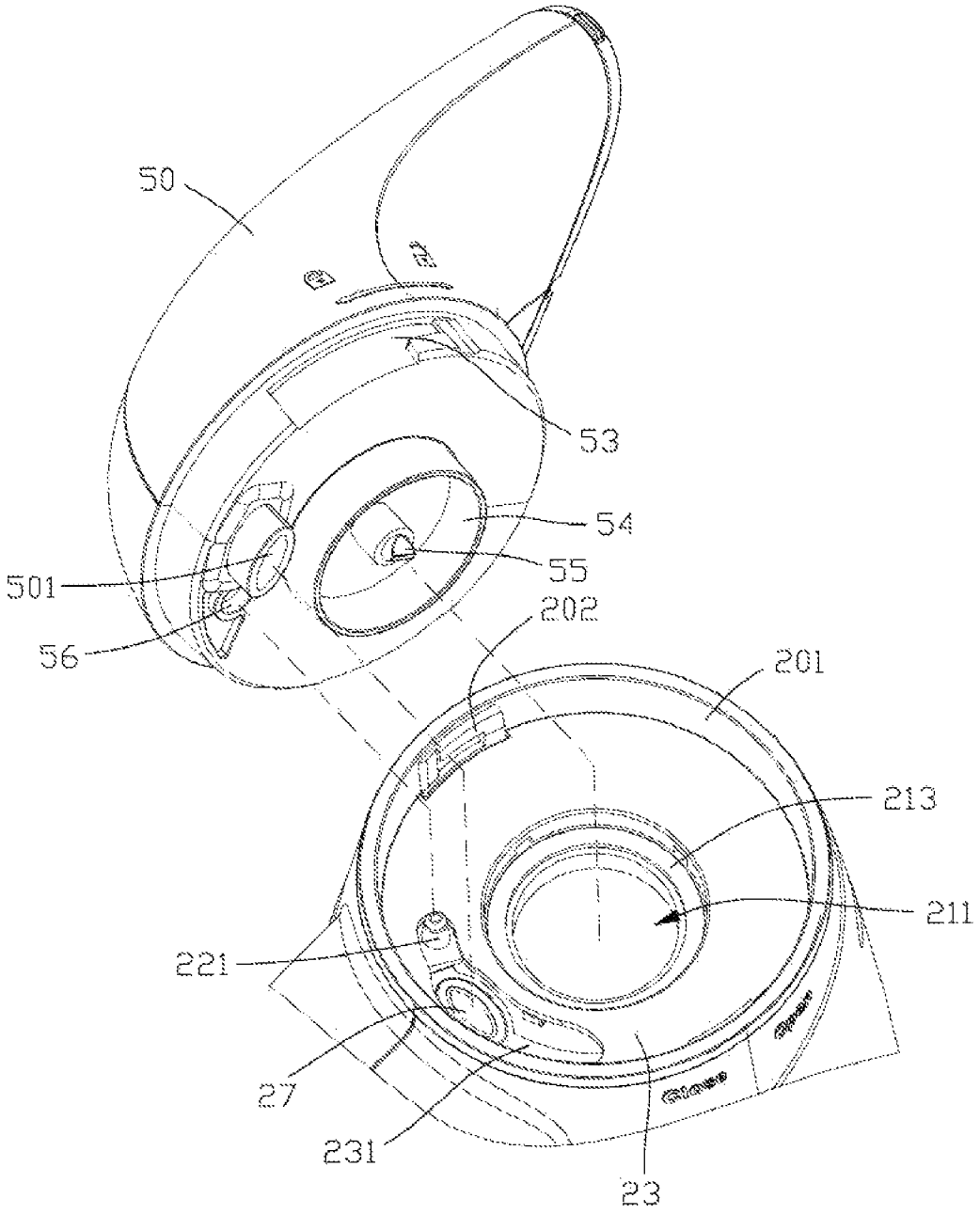
FIG. 4 is a schematic structural diagram of separation of a nozzle from a water tank in a specific implementation of the present disclosure.

Further, as shown in FIG. 4, the nozzle 50 is removable from the water tank 20. Further, the nozzle 50 is rotatably detachably connected to the water tank 20. Further, a side surface of the nozzle 50 is provided with a first L-shaped clamping structure 53. A top of the water tank 20 extends to form an annular wall 201. A side surface of the annular wall 201 is provided with a second L-shaped clamping structure 202. After a bottom end of the nozzle 50 is inserted to the water tank 20, the nozzle 50 is rotated, and the first L-shaped clamping structure 53 and the second L-shaped clamping structure 202 are clamped to connect the nozzle 50 with the water tank 20.

Figure 5:
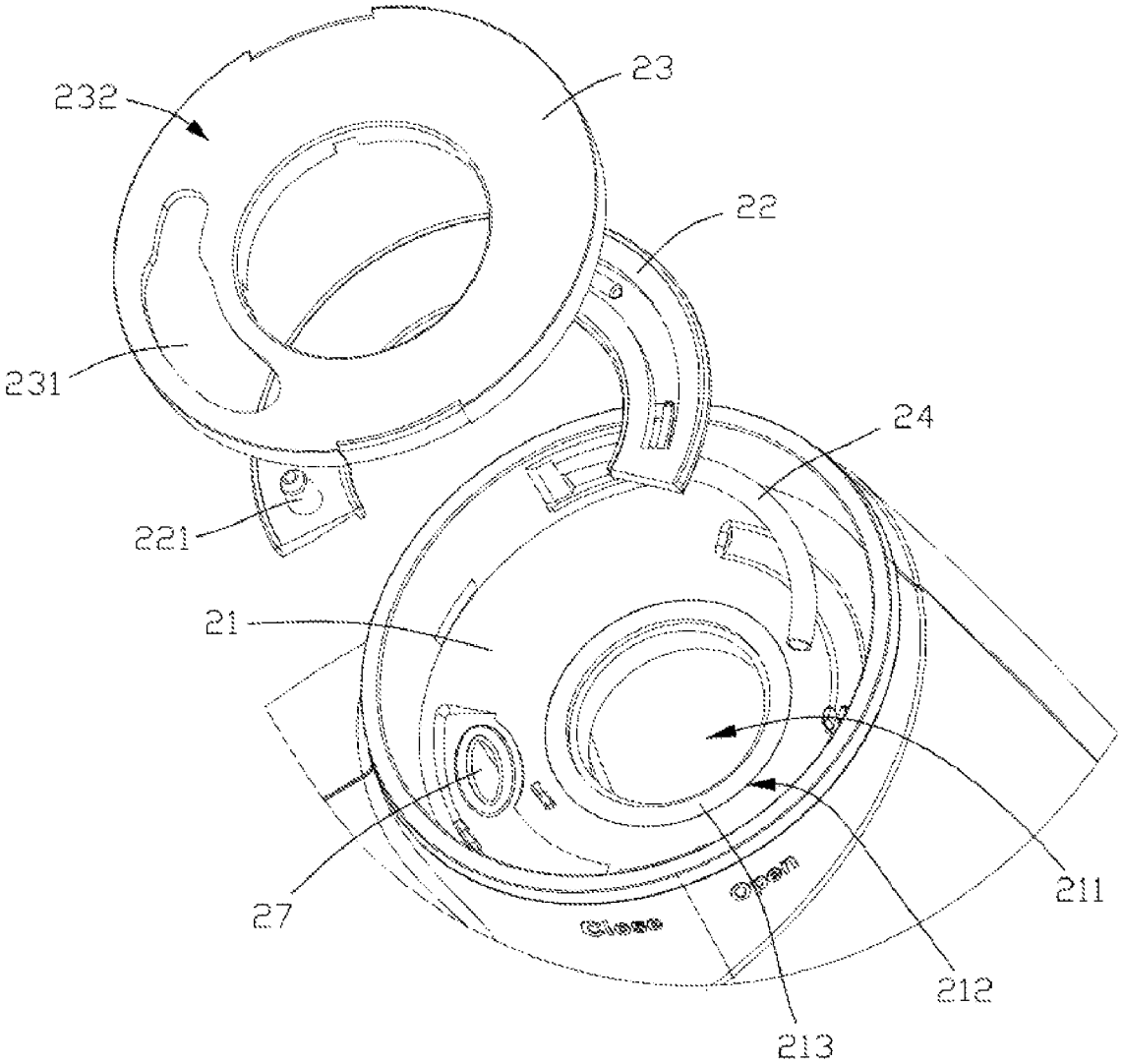
FIG. 5 is a partially structural exploded diagram of a specific implementation of the present disclosure.

As shown in FIG. 5, a top of the water tank 20 is provided with a top plate 21, and a water injection hole 211 is formed in a middle portion of the top plate 21. The top plate 21 is provided with a mounting slot 212 surrounding the water injection hole 211. A sealing ring 213 is mounted through the mounting slot 212. The sealing ring 213 surrounds the water injection hole 211. The nozzle 50 can be used as a cover of the water tank 20. The nozzle 50 includes an annular pressure plate 54 arranged at a bottom of the nozzle. When the nozzle 50 is connected with the water tank 20, the annular pressure plate 54 presses the sealing ring 213, so that the nozzle 50 closes the water injection hole 211. When the nozzle 50 is separated from the water tank 20, the water injection hole 211 is opened to inject water.

A bottom of the nozzle 50 is provided with a condensed water reflux inlet 55. The condensed water reflux inlet 55 is located on an inner side of the annular pressure plate 54. When the nozzle 50 is connected with the water tank 20, the condensed water reflux inlet 55 is aligned with the water injection hole 211. The condensed water reflux inlet 55 is connected with the steam chamber 52. Part of the steam is condensed into water in the steam chamber 52, then flows back to the condensed water reflux inlet 55, and then enters the water tank 20 through the water injection hole 211.

The nozzle 50 is provided with a steam inlet 501. The water tank 20 is provided with a steam outlet 27. The steam inlet 501 is abutted with the steam outlet 27 after the nozzle 50 is connected with the water tank 20. As shown in FIG. 2 and FIG. 3, the steam pipe includes a first pipe 71 and a second pipe 72. The first pipe 71 connects the steam outlet 27 with the evaporator 30, and the second pipe 72 connects the vent 521 with the steam inlet 501.

As shown in FIG. 5, the top plate 21 is movably connected with a cover plate 22. The cover plate 22 is preferably an arc-shaped plate. The cover plate 22 is arranged on a peripheral side of the water injection hole 211. The cover plate 22 is covered by a panel 23. The panel 23 defines a direction of movement of the cover plate 22. The panel 23 is preferably ringlike, and surrounds the peripheral side of the water injection opening 211. A top surface 232 of the panel 23 is a conical surface. The conical surface 232 is used as a flow guide surface during water injection. The panel 23 is provided with an elongated hole 231.

The cover plate 22 is provided with a first connection structure 221. The first connection structure 221 is exposed from the elongated hole 231. The nozzle 50 is provided with a second connection structure 56. The first connection structure 221 can be in connection fit with the second connection structure 56 to drive the cover plate 22 to move through rotation of the nozzle 50.

The first connection structure 221 is preferably a plunger, and the second connection structure 56 is preferably a socket. When the bottom end of the nozzle 50 is plugged to the water tank 20, the steam inlet 501 passes through the elongated hole 231. Furthermore, the plunger 221 is plugged into the socket 56. The nozzle 50 is screwed to rotate relative to the water tank 20. The nozzle 50 drives the cover plate 22 to rotate around the water injection hole 211.

Figure 6:
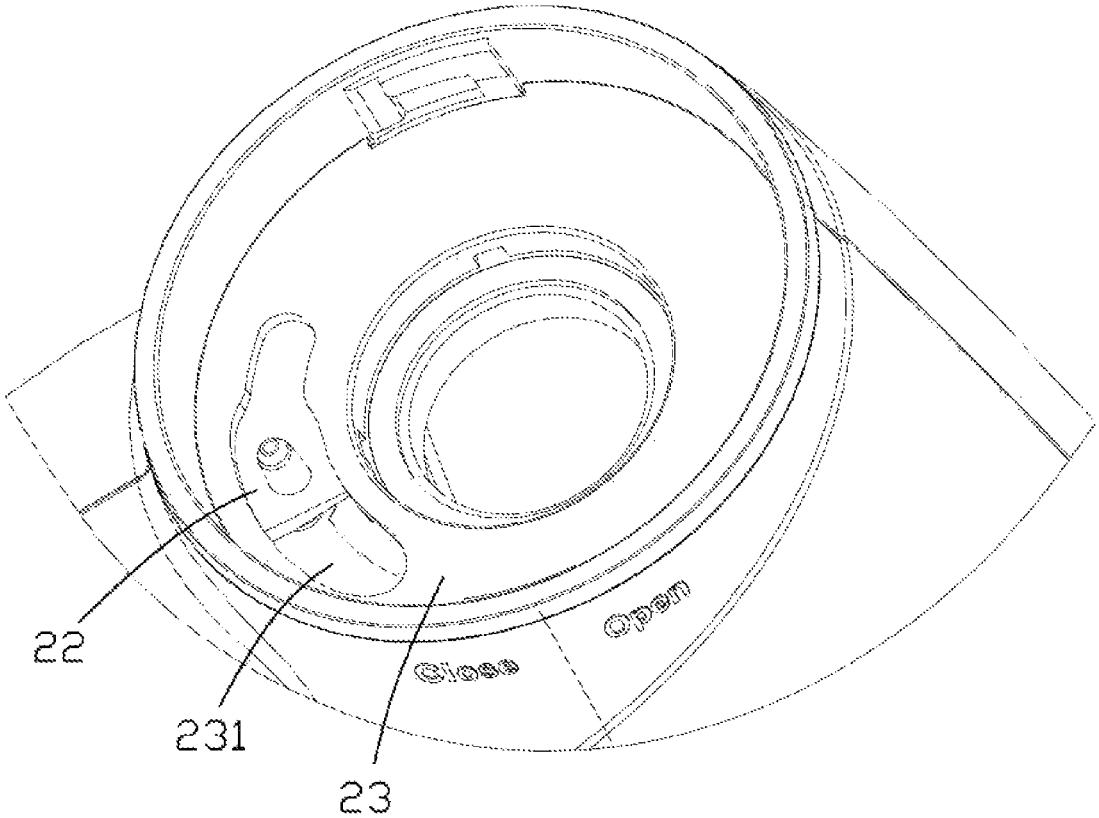
FIG. 6 is a schematic structural diagram illustrating that a steam outlet is closed by a cover plate of a specific implementation of the present disclosure.

As shown in FIG. 4, when the nozzle 50 rotates in a direction of being in fastened connection with the water tank 20, the cover plate 22 is driven to open the steam outlet 27. As shown in FIG. 6, when the nozzle 50 rotates in a direction of being separated from the water tank 20, the cover plate 22 is driven to close the steam outlet 27. In this way, the cover plate 22 moves with the nozzle 50. When the nozzle 50 is removed to expose the water injection hole 211 for water injection, the steam outlet 27 is closed by the cover plate 22, so it is not easy to inject water from the steam outlet 27 to the evaporator 30 by mistake during water injection.

The cover plate 22 is connected with an elastic member 24. The elastic member 24 is arranged on the top plate 21 and resists against the top plate 21. The elastic member 24 is preferably an arc-shaped member. The elastic member 24 provides a pre-tightening force for the cover plate 22. The pre-tightening force is used for keeping, when the nozzle 50 is separated from the water tank 20, the cover plate 22 in a state of closing the steam outlet 27.

The above mentioned contents are only preferable embodiments of the present disclosure and shall not be used to limit the present disclosure. Any modification, equivalent substitution, improvement, etc. made within the spirit and principle of the present disclosure shall all fall within the scope of protection of the present disclosure.

What is claimed is:

1. A handheld garment steamer, comprising:

a water tank, used for storing water;

an evaporator, arranged below the water tank and used for heating the water to make the water become water vapor;

a power pump, connected with the water tank and the evaporator and used for pumping the water in the water tank to the evaporator;

a nozzle, arranged above the water tank, wherein a vent of the nozzle is connected with the evaporator through a steam pipe;

a first temperature controller; and a second temperature controller, wherein the first temperature controller and the second temperature controller are used for monitoring a temperature of the evaporator;

when the temperature of the evaporator reaches a first preset temperature value, the second temperature controller and the water pump work;

when the temperature of the evaporator reaches a second preset temperature value, the evaporator is powered off; and the second preset temperature value is greater than the first preset temperature value.

2. The handheld garment steamer according to claim 1, wherein the nozzle is removable from the water tank; a steam inlet is arranged on the nozzle; a steam outlet is arranged on the water tank; the steam pipe comprises a first pipe and a second pipe; the first pipe is connected with the steam outlet and the evaporator; the second pipe is connected with the vent and the steam inlet; and the steam inlet is abutted with the steam outlet after the nozzle is connected with the water tank.

3. The handheld garment steamer according to claim 2, wherein a water injection hole is formed in a top of the water tank; and the nozzle is used as a cover for closing the water injection hole after the nozzle is connected with the water tank.

4. The handheld garment steamer according to claim 3, wherein the nozzle is rotatably detachably connected to the water tank; the water tank is movably connected with a cover plate; the cover plate is provided with a first connection structure; the nozzle is provided with a second connection structure; the first connection structure is in connection fit with the second connection structure, so that the nozzle rotates to drive the cover plate to move; when the nozzle rotates to an angle of being separated from the water tank, the cover plate is driven to close the steam outlet; and when the nozzle rotates to an angle of being in fastened connection to the water tank, the cover plate is driven to open the steam outlet.

5. The handheld garment steamer according to claim 4, wherein the cover plate is connected with an elastic member; the elastic member provides a pre-tightening force for the cover plate; and the pre-tightening force is used for keeping, when the nozzle is separated from the water tank, the cover plate in a state of closing the steam outlet.

6. The handheld garment steamer according to claim 5, wherein the cover plate is an arc-shaped plate; the cover plate is arranged on a peripheral side of the water injection hole; and the elastic member is an arc-shaped member.

7. The handheld garment steamer according to claim 4, wherein a panel covers the cover plate; the panel is provided with an elongated hole; the first connection structure is exposed by the elongated hole; and the steam inlet passes through the elongated hole after the nozzle is connected to the water tank.

8. The handheld garment steamer according to claim 7, wherein the panel surrounds the peripheral side of the water injection hole; a top surface of the panel is a conical surface; and the conical surface is used as a flow guide surface during water injection.

9. The handheld garment steamer according to claim 4, wherein a side surface of the nozzle is provided with a first L-shaped clamping structure; a top of the water tank extends to form an annular wall; a side surface of the annular wall is provided with a second L-shaped clamping structure; the first L-shaped clamping structure and the second L-shaped clamping structure are clamped to achieve rotatable detachable connection between the nozzle and the water tank.

10. The handheld garment steamer according to claim 3, wherein a condensed water reflux inlet is formed in a bottom of the nozzle; and the condensed water reflux inlet is aligned with the water injection hole when the nozzle is connected with the water tank.

* * * * *